US006896266B1

(12) United States Patent
Terminel

(10) Patent No.: US 6,896,266 B1
(45) Date of Patent: May 24, 2005

(54) METHOD FOR FACILITATING THE PLAY OF TWENTY-ONE

(76) Inventor: Fernando N. Terminel, 3331 Marlette Cir., South Lake Tahoe, CA (US) 96150

( * ) Notice: Subject to any disclaimer, the term of this patent is extended or adjusted under 35 U.S.C. 154(b) by 0 days.

(21) Appl. No.: 10/876,384

(22) Filed: Jun. 25, 2004

(51) Int. Cl.[7] ..... A63F 1/00
(52) U.S. Cl. ..... 273/292; 273/274
(58) Field of Search ..... 273/292, 274, 273/309; 463/12

(56) References Cited

U.S. PATENT DOCUMENTS 5,743,532 A * 4/1998 Lafferty ..... 273/292
6,158,741 A * 12/2000 Koelling ..... 273/292
6,536,767 B1 * 3/2003 Keller ..... 273/292

* cited by examiner

*Primary Examiner*—Benjamin Layno

(57) ABSTRACT

A side bet for Blackjack also known as twenty-one is disclosed. The player places a side wager that the dealer's up card will be a ten-value card. If the dealer's up card is a ten-value card, then the player is paid 1 to 1. Potential additional side payoffs include whether the dealer's hole card is a ten-value card, in which case the player wins 3 to 1 or whether the dealer's hole card is an ace, in which case the player is paid 6 to 1. Other potential side payoffs are also disclosed.

9 Claims, No Drawing Sheets

METHOD FOR FACILITATING THE PLAY OF TWENTY-ONE

FIELD OF THE INVENTION

This invention relates to methods of playing games and methods of amusement; in particular, this invention relates to methods of playing wagering games, especially wagering games in the context of a casino or other commercial venue; most particularly this intention relates to methods of playing card games at tables in a casino or other commercial venue and virtual card games in self contained games in the casino environment.

STATE OF THE ART

The card game known as Blackjack or Twenty-One is a common card game played for recreation in every conceivable venue, including homes, dormitory rooms, lunch rooms and, of course, in casinos and other organized venues for the promotion of wagering throughout the world. In Twenty-One the outcome is determined by either the player or the dealer having the highest hand value that does not total more than twenty one as defined by the numerical amounts of the cards in the hand value. The hand value is defined by the numerical value of the cards dealt with two exceptions: a) the face cards are all defined to have a value of ten, and b) the ace may have a value of either one or eleven at the player's option. The best hand is called the blackjack, and consists of a two card hand totaling twenty one, which is a hand comprising an ace and a ten.

As the game is typically played, insurance, doubling down, and splitting a pair are the only side bets normally allowed, when "side bet" is defined as a bet that requires an additional wager, and is based on an occurrence that may or may not affect the ultimate outcome of the game. The two traditional side bets mentioned illustrate the concept. When the dealer shows an ace a player may place a second bet to 'insure' that the dealer doesn't have a ten as his down card. If the dealer has some other card than a ten, the player loses the wager for the insurance, play continues for that hand, and the player may still win the hand.

Similarly, the player may double down by placing a second bet after the first two cards have been dealt that the next card dealt to him will give him a better hand than the dealer—that is, his three card hand will beat the hand the dealer eventually will wind up with.

Splitting a pair is not quit a side bet as herein defined, since the player splits a pair of cards, for example a 9-9, and then player plays both of the two hands to the conclusion of the game, each hand containing a 9 from his original hand. He may usually split the next hand if he gets a third 9. Of course the rules for these side bets may vary from casino to casino.

The need for casinos to attract more customers, particularly the casual player who may not fully understand the table games, has caused a recent upsurge in interest in developing new easy to understand and play side-bets for established table games such as Twenty-One. The need has resulted in several innovations in table games found in casinos. Some have filled the need admirably, but the average life time for a variant side bet game is short enough that there remains a continuing need for candidate games.

SUMMARY OF THE INVENTION

A card game that can be a side bet or an adjunct to the casino card game of twenty-one is played by placing a wager that the face up card of a dealer will be a value of ten; dealing to at least one player the first two cards of a twenty-one game from at least one randomly shuffled deck of cards containing at least one standard playing card deck of fifty two cards; dealing to a dealer two cards, the first of said cards being dealt one face up, and the second of said cards, a hole card, being dealt face down; determining if the dealers face up card is a card with a value of ten: which is a ten card, a jack card, a queen card or a king card; then depending on the value of the face up card following one of two courses of action, if there is no ten, jack, queen or king showing, collecting the money bet the ten wager, then continuing to deal the twenty-one game until its resolution; if the dealer has a ten card showing, paying the wager at a first predetermined amount if his hole card is an Ace, paying the wager at a second predetermined amount if his hole card is a ten, paying the wager at a third predetermined amount if he has anything other than an ace or a ten; then continuing to deal the twenty-one game until its resolution This invention provides a method for playing a modified form of blackjack or twenty-one played with at least one standard deck of at least fifty two cards consists of wagering whether the dealer has a winning hand based on the observation that the dealer has dealt himself a ten as an up card.

In particular this invention provides a card game comprising the method of:

- Placing a wager that the face up card of a dealer will be a value of ten; Dealing to at least one player the first two cards of a twenty-one game from at least one randomly shuffled deck of cards containing at least one standard playing card deck of fifty two cards;
- Dealing to a dealer two cards, the first of said cards being dealt one face up, and the second of said cards, a hole card, being dealt face down;
- Determining if the dealers face up card is a card with a value of ten: a ten crd, a jack card, a queen card, or a king card;
- If the dealers face up card is not a ten, jack, queen or king, collecting the money bet the ten wager,
  - then continuing to deal the twenty-one game until its resolution;
- If the dealer has a ten card showing,
  - paying the wager at a first predetermined amount if his hole card is an Ace,
  - paying the wager at a second predetermined amount if his hole card is a ten, and
  - paying the wager at a third predetermined amount if he has anything other than an ace or a ten value card;
  - then continuing to deal the twenty-one game until its resolution.

DETAILED DESCRIPTION OF THE PREFERRED EMBODIMENT

Blackjack or twenty one is defined herein as a game wherein a first participant, hereinafter the 'dealer', who plays for the house, deals two cards apiece to a second participant, hereinafter the 'player', and himself. The player is therefore really playing against the house. The point of the game is for the player to match or beat the dealer's cards without going over twenty one points, called going 'bust.' Points are determined by the number of the card: that is a 2 is worth two points, a 3, three points and so forth, up to a 10 being worth ten points. The face cards, that is the Jacks, Queens, and Kings, are all worth ten points and an ace is worth either one point (which is used in what is termed a 'hard' hand) or eleven points (which is used in a 'soft' hand). The best hand is twenty one points, which can be achieved by any number of cards but the two card hand of an ace, counted here as an eleven, and any card worth ten points, which hand is called a Blackjack, is considered the best.

Herein, a deck of cards will considered to be a deck containing a minimum of fifty two cards including an ace (A), 2, 3, 4, 5, 6, 7, 8, 9, 10, Jack (J), Queen (Q), and King (K) in the four suits of clubs, spades, hearts and diamonds. J, Q, and K are defined as the face cards; and face cards and ten cards have a value of ten in the game of twenty one. A two card hand will herein be denoted as, for example, 2-7 for a hand containing a two, of any suit, and a seven, of any suit. Other cards may be added to the deck, such as jokers or the like, so the total number of cards may well be higher than fifty two. Moreover, from one to seven or more extra decks may be added to the original first deck. However, the "deck" as defined herein will always contain at least the fifty two cards of the standard deck, and those fifty two cards will always be randomly shuffled before being dealt to the player.

As used herein, a "card" can be a physical elongate paper or plastic item with a numerical value printed thereon, or it can be a virtual card, which is defined herein is any representation of a playing card that may look identical to the numerical side of a physical card or may be abbreviated, having, for example, only a number and a suit identified thereon. Virtual cards are used in conjunction with a computer, or similar digital processing means, which will display the virtual card on a video display monitor or other active display device. As used herein, the term "video monitor" includes CRT video monitors and all equivalents of CRT video monitors such as LED screens and plasma screen displays of any sort that displays graphical images of digital information.

If virtual cards are used then the "dealer" will usually be a virtual dealer. The virtual dealer is a computer, specifically the processor of the computer. The processor calculates the values of the hands as they are played and displays the hands to the player on a display device. In general, the player will activate the processor by dropping a coin into a slot and pressing a button. However, strictly computer driven games, that include no possibility of money changing hands are also contemplated by the invention—for example, games played at home and the like strictly for amusement or for practice for actual play in a casino. If one uses a computer style of game, the dealer's role remains unchanged from what it would be if the dealer was a live person standing or sitting at the gaming table. Therefore, as used herein, the term "dealer" will includes both live dealer and the virtual dealer created by the processor.

The dealer does not normally participate beyond dealing in most twenty one games, but the person playing the dealer may be rotated in and out, and the dealer may play hands against himself—thereby lowering the likelihood of a player winning any given hand. There may be between one to as many as seven players in the normal casino version of the blackjack or twenty one game, although, in theory, the number of players could be much greater.

This invention is a method of playing the game of twenty-one between either a live dealer or a virtual dealer. The dealer may be dealing either real cards or virtual cards. The dealer, live or virtual, will deal to at least one live twenty-one player. The player will place a first wager on whether the twenty-one player or the dealer will win the twenty-one game. This is the standard bet in Twenty-one. The player may then place a second bet if the dealer shows a ten that the dealer will win the hand. That is, if the player knows the dealer has deal himself a 10, he may place a wager that the dealer will win the hand, or, the player may place the bet at the same time he makes the wager on the twenty one hand.

The dealer deals to the player the first two cards of a twenty-one game from at least one randomly shuffled deck of cards containing at least one standard playing card deck of fifty two cards. The dealer also deals himself two cards, one face up, and one face down. The face down card is the "hole" card. It will be appreciated that if the dealer is a virtual dealer, the deck of cards is formed by shuffling 52 numbers, each representing a card using any of several standard algorithms.

Images of the randomly shuffled cards are then presented on the video monitor.

Once the first two cards are dealt, if the dealer has a ten card showing, he will resolve the first wager, if he does not, he will collect the money wagered for the ten wager, then he will continue to deal the twenty-one game until its resolution.

It will be realized that this game can be played without any monetary wager or bet being made. All that needs be done is that the player have some means of indicator means to indicate whether he wants to play this form of cards, and an indication or indicator proving that he has won or he lost the hand.

If the dealer has a ten card showing, he will pay 6 to one if his hole card is an Ace, 3 to one if his hole card is a ten, and 1 to 1 if he has anything other than an ace or a ten. The wager described is on the first two cards dealt only, that is to say, if the dealer draws a ten for any other card he may deal to himself, there is no money to be paid to the player.

A preferred mode of playing this game includes an optional bonus bet as part of the payout for the side bet, where if the dealer has a ten card, and his face down or hole card is also a ten card (the ten cards here being the card between a nine and a jack ONLY) the player receives an enhanced bonus, usually about 40 to one.

This invention has been described in detail with reference to specific embodiments of the invention and examples thereof. Alterations, modifications, and other changes to those embodiments and examples will invariably suggest themselves to those of ordinary skill in the art relating to this invention. Therefore, it is intended that the scope of this invention should be determined solely by reference to the appended claims, which appended claims encompass all such alterations, modifications, and changes.

I claim:

1. A card game comprising the method of:

Placing a wager that the face up card of a dealer will be a value of ten;

Dealing to at least one player the first two cards of a twenty-one game from at least one randomly shuffled deck of cards containing at least one standard playing card deck of fifty two cards;

Dealing to a dealer two cards, the first of said cards being dealt one face up, and the second of said cards, a hole card, being dealt face down;

Determining if the dealers face up card is a card with a value of ten, a jack, a queen, or a king;

If the dealers face up card is not a ten, jack, queen or king, collecting the money bet the ten wager, then continuing to deal the twenty-one game until its resolution;

If the dealer has a ten card showing, paying the wager at a first predetermined amount if his hole card is an Ace, paying the wager at a second predetermined amount if his hole card is a ten, and paying the wager at a third predetermined amount if he has anything other than an ace or a ten;

then continuing to deal the twenty-one game until its resolution.

2. The method of claim 1 wherein the method further comprises paying no money to the player if the dealer draws a ten on any subsequent card.

3. The method of claim 1 wherein the method further comprises playing the game using a virtual dealer.

4. The method of claim 1 wherein the method further comprises paying the first amount at 6 to one, the second amount at 3 to one, and the third amount at one to one.

5. The method of claim 1 wherein the method further includes using more than one standard deck of playing cards.

6. The method of claim 1 wherein the method further includes dealing from a shoe.

7. The method of claim 1 wherein the method further includes placing standard bets on the twenty-one game and placing the tens bet as a side bet.

8. The method of claim 1 wherein the method further includes an enhanced bonus is the deal has a ten card face up, and his down card is also a ten, then the player gets an enhanced payout of at least 10 to one.

9. A card game comprising the method of:

Dealing to at least one player the first two cards of a twenty-one game from at least one randomly shuffled deck of cards containing at least one standard playing card deck of fifty two cards;

Dealing to a dealer two cards, the first of said cards being dealt one face up, and the second of said cards, a hole card, being dealt face down;

Determining if the dealers face up card is a card with a value of ten, a jack, a queen, or a king;

If the dealers face up card is not a ten, jack, queen or king,

Having an indicator that indicates that the player has lost this bet, then continuing to deal the twenty-one game until its resolution;

If the dealer has a ten card showing,

Indicating that the player has won this hand, paying the wager at a second predetermined amount if his hole card is a ten, and paying the wager at a third predetermined amount if he has anything other than an ace or a ten;

then continuing to deal the twenty-one game until its resolution.

* * * * *